US007059016B2

(12) United States Patent
Markl

(10) Patent No.: US 7,059,016 B2
(45) Date of Patent: Jun. 13, 2006

(54) AUTOMOTIVE DOOR CHECK ASSEMBLIES

(75) Inventor: Norbert A. Markl, Placentia, CA (US)

(73) Assignee: Illinois Tool Works Inc, Glenview, IL (US)

( * ) Notice: Subject to any disclaimer, the term of this patent is extended or adjusted under 35 U.S.C. 154(b) by 113 days.

(21) Appl. No.: 10/976,470

(22) Filed: Oct. 29, 2004

(65) Prior Publication Data

US 2005/0183235 A1 Aug. 25, 2005

Related U.S. Application Data

(60) Provisional application No. 60/546,022, filed on Feb. 19, 2004, provisional application No. 60/557,789, filed on Mar. 30, 2004.

(51) Int. Cl.
*E05F 5/02* (2006.01)

(52) U.S. Cl. ..... 16/82

(58) Field of Classification Search ..... 16/49, 16/54, 68, 50, 82, 85, DIG. 10, DIG. 17, 16/DIG. 21, 86 B; 292/137, 163, 252, DIG. 252; 296/146.11–146.13; 267/293, 136, 140.2, 267/140.11–140.13

See application file for complete search history.

(56) References Cited

U.S. PATENT DOCUMENTS

| | | | | |
|---|---|---|---|---|
| 4,212,379 | A * | 7/1980 | Zoino | 192/52.3 |
| 4,491,355 | A * | 1/1985 | Marinoni | 292/263 |
| 5,152,029 | A * | 10/1992 | Pai | 16/54 |
| 5,165,509 | A * | 11/1992 | Kanno et al. | 192/44 |
| 6,629,334 | B1 * | 10/2003 | Huang | 16/50 |

FOREIGN PATENT DOCUMENTS

| | | |
|---|---|---|
| DE | 102 13 356 C1 | 9/2003 |
| DE | 102 28 435 C1 | 12/2003 |
| EP | 1138859 | 4/2001 |
| GB | 1096723 | 12/1967 |

* cited by examiner

*Primary Examiner*—Robert J. Sandy
*Assistant Examiner*—Andre' L. Jackson
(74) *Attorney, Agent, or Firm*—Mark W. Croll; Paul F. Donovan

(57) ABSTRACT

This invention relates to door check assemblies capable of holding a door in a number of predetermined open positions with a predetermined force. In particular, the invention relates to an automotive door check device capable of holding an automotive door in a number of predetermined open positions with a predetermined force. In preferred embodiments, the invention is capable of holding a door in an infinite number of open positions.

18 Claims, 10 Drawing Sheets

600

AUTOMOTIVE DOOR CHECK ASSEMBLIES

This application claims priority to U.S. Provisional Application Ser. No. 60/546,022, filed Feb. 19, 2004, and U.S. Provisional Application Ser. No. 60/557,789, filed Mar. 30, 2004, which are herein incorporated by reference in their entireties.

FIELD OF THE INVENTION

This invention relates to door check assemblies that hold a door in a number of predetermined open positions with a predetermined force. In particular, the invention relates to an automotive door check device that holds an automotive door in a number of predetermined open positions with a predetermined force. In preferred embodiments, the invention is capable of holding a door in an infinite number of open positions.

BACKGROUND

It is desirable to check the movement of an automotive door in a number of predetermined open positions to assure convenient and safe entrance and exit of the occupants. An automotive door is normally checked against movement in at least one open position with an effort or resistive force adequate to resist wind gusts and the effect of parking on a grade.

A common form of automotive door check is a mechanical device that resists motion by releasably storing energy in response to forced motion of the system. These devices, often located between a vehicle pillar and door, can be configured to be integral with the door hinge or separate as autonomous mechanical assemblies. Energy storage is generally achieved by using a form of spring with coil and torsion arrangements being the most popular configurations. As the door is opened or closed, the door check device is configured to release energy entering the check positions and to store it when moving out of the check positions. One method of storing energy in the spring system is by means of a cam arrangement that moves in conjunction with the door. This cam can work within the hinge to ultimately produce a torque around the pivot axis of the hinge, or can work linearly in a separate checking device which produces a force vector to resist door movement at selected open positions.

Typically, the cam arrangement takes the form of a roller that that follows a cam profile. Pressure is provided by springs or rubber pucks. Common problems with these arrangements include exposure of the springs or rubber puck to the elements, including moisture and dust, the need for maintenance such as lubrication, and the degradation of the mechanism that provides the resistive force (i.e., the spring or rubber puck).

Accordingly, what is needed is an automobile door check assembly is that is protected against the elements and reduces premature failure.

SUMMARY OF THE INVENTION

This invention relates to door check assemblies capable of holding a door in a number of predetermined open positions with a predetermined force. In particular, the invention relates to an automotive door check device capable of holding an automotive door in a number of predetermined open positions with a predetermined force. In preferred embodiments, the invention is capable of holding a door in an infinite number of open positions.

In certain embodiments, the present invention provides a device for checking rotation of a hinge pin, comprising a first outer cone and a first inner cone positioned within the first outer cone and biased against the outer cone so the first inner and outer cones engage one another, wherein the first inner cone has an opening therein for receiving a hinge pin so that when the hinge pin is rotated, the first inner cone rotates within the first outer cone. In preferred embodiments, the device further comprises a housing, with the first outer cone positioned within the housing to substantially prevent rotation of the first outer cone within the housing. In other preferred embodiments, the first outer cone further comprises a first outer cone flange that engages the housing to substantially prevent rotation of the first outer cone within the housing. In preferred embodiments, the housing and the first outer cone flange are hexagonal in shape.

In some preferred embodiments, the device further comprises a spring, wherein the spring is positioned in the housing to bias the inner cone against the outer cone. In preferred embodiments, the first outer cone flange has upper and lower surfaces, with the first outer cone flange upper surface having therein at least three ball bearings, and wherein the first inner cone comprises a flange having upper and lower surfaces, with the first inner cone lower surface comprising a cam surface that engages the ball bearings. In other preferred embodiments, the cam surface has a series of indexed depressions therein so that the inner cone is moveable between a locked position wherein the ball bearings are located in the depressions and the first inner and outer cones are engaged and a release position wherein the ball bearings exit the depressions and cause the first upper and lower cones to disengage thereby allowing ease of movement about the hinge pin.

In some preferred embodiments, the device further comprises a second inner cone having an opening therein for receiving the hinge pin and comprising a flange having an upper surface and a lower surface, with the device further comprising a second outer cone comprising a flange that engages the housing, with first and second inner cones opposed to one another so that the spring engages the first and second inner cone flanges. In other preferred embodiments, the second outer cone flange has upper and lower surfaces, with the second outer cone flange lower surface having therein at least three ball bearings, and wherein the second inner cone flange upper surface comprises a cam surface that engages the ball bearings. In yet other preferred embodiments, the cam surface has a series of indexed depressions therein so that the second inner cone is moveable between a locked position wherein the ball bearings are located in the depressions and the second inner and outer cones are engaged and a release position wherein upon rotation the ball bearings exit the depressions and cause the second upper and lower cones to disengage thereby allowing ease of movement about the hinge pin. In preferred embodiments, the device further comprises a housing cover having a hinge pin opening therein.

In preferred embodiments, the first outer cone flange comprises upper and lower surfaces, with the first outer cone flange lower surface having at least three ball bearing therein, with the device further comprising a cam plate comprising a cam surface opposed to the first outer cone flange lower surface, the cam surface having therein a series of depressions corresponding to the positions of the at least three ball bearings. In preferred embodiments, the first inner cone comprises a flange having an upper surface, the cam plate comprises at least one upwardly extending locking member and the first outer cone flange has at least one opening therein for receiving the upwardly extending locking member, with the opening sized to allow movement of the at least one upwardly extending locking member within the opening between lock and release positions, with the device further comprising a friction disc between the cam plate and the first inner cone flange upper surface so that the first inner cone is movable between a locked position wherein the ball bearings are located in the depressions and the first outer and inner cones are engaged and a release position wherein upon rotation of the inner cone the friction disc causes the cam plate to rotate so that the ball bearings cause the first outer cone to disengage the first inner cone so that the hinge pin pivots, and wherein the rotation of the cam plate is limited by the engagement of the upwardly extending locking member with the first outer cone flange.

In preferred embodiments, the device further comprises a cover fixed to the housing, with the cover having therein an opening for receiving the hinge pin and comprising a cover interior surface, wherein the spring is biased against the cover lower surface and the outer cone flange. In preferred embodiments, the device further comprises a washer between the cover lower surface and the inner cone.

In certain embodiments, the present invention provides a device for checking rotation of a hinge pin, comprising a first outer cone with a flange having at least three ball bearings therein and a first inner cone with a cam surface having depressions therein; wherein the first inner cone has an opening therein for receiving a hinge pin so that when the hinge pin is rotated, the first inner cone rotates within the first outer cone and wherein the cam surface engages the ball bearings such that in a locked position the ball bearings are located within the indexed depressions and the inner and outer cones are engaged, and in a release position the ball bearings exit the indexed depressions and the inner and outer cones disengage thereby allowing ease of movement about the hinge pin.

In certain embodiments, the present invention provides a device for checking rotation of a hinge pin, comprising an outer cone comprising a flange containing at least three ball bearings and at least one cam plate upwardly extending locking member opening; an inner cone having an opening therein for receiving a hinge pin such that when said hinge pin is rotated, the inner cone rotates within first outer cone; a cam plate positioned between the inner and outer cone flanges, the cam plate comprising depressions corresponding to the positions of the ball bearings and at least one upwardly extending locking member positioned within the at least one recess in the outer cone flange, the recess sized to allow movement of the upwardly extending locking member between lock and release positions wherein the rotation of the cam plate is limited by the engagement of the upwardly extending locking member with the outer cone flange; and a friction disc between the cam plate and the first inner cone flange upper surface, wherein the first inner cone is movable between a locked position wherein the ball bearings are located in the depressions and the first outer and inner cones are engaged and a release position wherein upon rotation of the inner cone the friction disc causes the cam plate to rotate so that the interaction of the ball bearings with the cam plate causes said first outer cone to disengage said first inner cone.

DETAILED DESCRIPTION

The present invention provides door check devices that are useful with a variety of doors as well as other devices that utilize hinges such as gates. In some embodiments, the door check devices of the present invention utilize tapered cones to provide a resistive force (e.g., friction). The tapered cones, which are preferably comprised of metal, do not substantially degrade with use and maintain their profile and locking characteristics. In further preferred embodiments, the tapered cones and the rest of the check mechanism are enclosed in a housing so that they are protected from environmental elements such as dust, grit, salt and moisture. In preferred embodiments, the door checks require little maintenance such as lubrication. In some embodiments, the door check device of the present invention permits a door or other device utilizing a hinge to be opened to an infinite number of positions. In further preferred embodiments, the door check devices can be retrofitted to existing hinge mechanisms.

FIGS. 1–11 illustrate various preferred embodiments of the door check devices of the present invention. The present invention is not limited to these particular embodiments. Embodiments of the present invention are exemplified by reference to two types of door check devices: 1) a friction door check device and 2) an infinite position door check device.

Friction Door Check Device

A preferred embodiment of a door check device of the present invention is provided in FIGS. 1–5. The friction door check device is applicable for use with automobiles (e.g., automobile doors, automobile hoods, automobile trunks, etc.), and indeed, with any device that utilizes a hinge. The friction door check device permits a door to be opened to predetermined positions. The present invention is not limited to any particular mechanism. Indeed, an understanding of the mechanism is not necessary to practice the present invention. Nevertheless, it is contemplated that the friction door check device functions on the principle that high friction is attained through pushing a tapered cone onto a tapered sleeve (described in more detail below).

Figure 1:
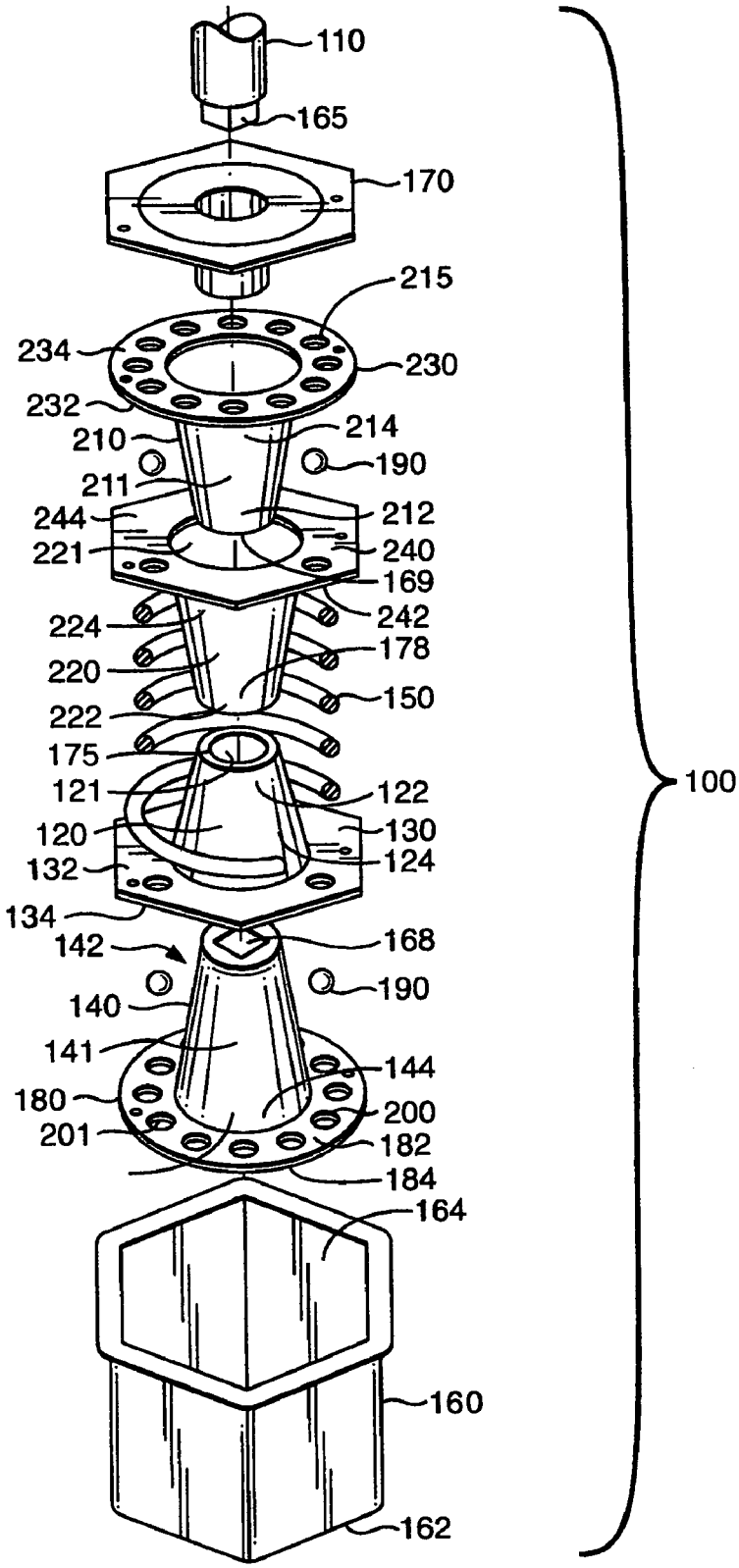
FIG. 1 is an exploded view of a friction door check device.

Referring to FIG. 1, the friction door check device 100 is configured to receive and interface with a hinge pin 110. In some embodiments, the friction door check device 100 comprises first and second outer cones 120 and 220 having first and second outer cone flanges 130 and 240, first and second inner cones 140 and 210 having a first and second inner cone flanges 180 and 230, a spring 150, a housing 160, and a housing cover 170. The components of the friction door check device 100 are not limited to a particular material composition (e.g., steel, plastic, titanium, or mixture thereof). In preferred embodiments, the material composition of the components of the friction door check device 100 is draw quality steel (e.g., SAE 1050 Draw Quality Steel). In some embodiments, the first and second outer cones 120 and 220 are heat treated to a desired hardness (e.g., RC values 45–50 or RB values between 1 and 100). In preferred embodiments, the first and second outer cones 120 and 220 are heat treated to a RC 45–50 or RB 70 hardness. In some embodiments, the first and second inner cones 140 and 210 are heat treated to a desired hardness (e.g., RC values 45–50 or RB values between 1 and 100). In preferred embodiments, the first and second inner cones 140 and 210 are heat treated to a RC 45–50 or RB 50 hardness.

Still referring to FIG. 1, the hinge pin 110 comprises a shaped (e.g., circular shaped, oval shaped, square shaped, rectangular shaped, star shaped) drive 165 at the distal end of the hinge pin 110 that corresponds to a similarly shaped opening 168 in the end of the first inner cone 140 (described in more detail below). In preferred embodiments, the hinge pin 110 drive is square shaped. In some preferred embodiments, the hinge pin 110 is secured to the first inner cone 140 by riveting over the end of the hinge pin (see FIG. 2). Upon assembly of the friction door check device 100, the drive of the hinge pin 110 is swaged to form a head, which serves to hold the device together (described in more detail below).

Still referring to FIG. 1, the shape of the first and second outer cones 120 and 220 is conical with narrowed top ends 122 and 222 and wider bottom ends 124 and 224. The top ends 122 and 222 of the first and second outer cones 120 and 220 contain openings 175 and 178 through which the hinge pin 110 is insertable. The first and second outer cones 120 and 220 further have first and second outer cone engagement surfaces 121 and 221. First and second outer cone flanges 130 and 240 extend from the respective bottom ends 124 and 224 and of the first and second outer cones 120 and 220. The first and second outer cone flanges 130 and 240 can be any desired shape (e.g., non-circular shaped, hexagonal shaped, oval shaped, square shaped, rectangular shaped, star shaped). In preferred embodiments, the shape of the first and second outer cone flange 130 and 240 correspond to the shape of the housing 160 so as to prevent rotation of the first and second outer cones 120 and 220 within the housing 160 while permitting axial movement of the first and second outer cones 120 and 220 (described in more detail below). In some preferred embodiments, the first and second outer cone flanges 130 and 240 is hexagonal in shape.

Still referring to FIG. 1, the shape of the first and second inner cones 140 and 210 is conical with narrowed top ends 142 and 212 and wider bottom ends 144 and 214. The top and bottom ends 142 and 212 have openings 168 and 169 therein to receive the hinge pin 110. The first and second inner cones 140 and 210 further have first and second inner cone engagement surfaces 141 and 211. The first and second outer cones 120 and 220 fit onto the first and second inner cones 140 and 210, respectively, such that the first inner cone engagement surface 141 engages the first outer cone engagement surface 121 and second inner cone engagement surface 211 engages the second outer cone engagement surface 221 (described in more detail below).

Still referring to FIG. 1, the housing 160 has a closed bottom end 162 and an open top end 164. The housing 160 may assume any type of shape (e.g., non-circular shaped, hexagonal shaped oval shaped, square shaped, rectangular shaped, star shaped). In preferred embodiments, the shape of the housing 160 corresponds to the shape of the first and second outer cone flanges 130 and 240. In particular preferred embodiments, the housing 160 is hexagonal in shape. The housing 160 is not limited to a particular width or depth. In preferred embodiments, the shape of the first and second outer cone flanges 130 and 240 aligns with the shape of the housing 160 such that rotation of the first and second outer cones 120 and 220 within the housing 160 is substantially prevented, while axial movement of the first and second outer cones 120 and 220 is permitted (described in more detail below).

Still referring to FIG. 1, the spring 150 is not limited to a particular material composition. In preferred embodiments, the spring 150 is a coiled spring. Upon assembly of the friction door check device 100, the spring 150 extends around the first and second outer cones 120 and 220 and contacts the outer cone flanges 130 and 240. Thus, the spring 150 provides a force to bias the first and second outer cones 120 and 220 against the inner cones 140 and 210 (described in more detail below).

In some embodiments, as shown in FIG. 1, the first and second outer cone flanges 130 and 240 have upper surfaces 132 and 242 and lower surfaces 134 and 244. Likewise, the first and second inner cones 140 and 210 comprise first and second inner cone flanges 180 and 230 having upper surfaces 182 and 232 and lower surfaces 184 and 234. In further embodiments, the lower surfaces 134 and 244 of the first and second outer cone flanges 130 and 180 have a plurality of pockets therein that contain outer cone flange ball bearings 190. In preferred embodiments, the first and second outer cone flanges 130 and 180 have three ball bearings in each respective flange. In some embodiments, the upper surfaces 182 and 232 of the first and second inner cone flanges 180 and 230 have first and second inner cone flange cam surfaces 200 and 215. In preferred embodiments, the first and second inner cone flange cam surface 200 and 215 are engageable with the outer cone flange ball bearings 190 (described in more detail below).

In some embodiments, as shown in FIG. 1, the first 200 and second inner cone flange cam surfaces 215 (not shown in FIG. 1, described in more detail below in reference to FIG. 3) comprise a series of indexed depressions 201. In preferred embodiments, the indexed depressions along the first and second inner cone flange cam surfaces 200 and 215 are sized to receive the first outer cone flange ball bearings 190.

In preferred embodiments, as shown in FIG. 1, the first and second inner cones 140 and 210 are moveable between locked and release positions. In the locked position, the outer cone flange ball bearings 190 are located in the indexed depressions along the first and second inner cone flange cam surfaces 200 and 210, and the first and second inner cones 140 and 210 are engaged with the respective first and second outer cones 120 and 210. In the release position, the outer cone flange ball bearings 190 exit the indexed depressions along the first inner cone flange cam surface 200 causing the first and second inner cones 140 and 210 to disengage from the first and second outer cones 120 and 220 thereby allowing ease of movement about the hinge pin 110 (described in more detail below).

Still referring to FIG. 1, the housing cover 170 has a central opening therein through which the hinge pin 110 is insertable. Upon assembly of the friction door check device 100, the housing cover 170 encloses the housing 160 and serves as a guide for the insertion of the hinge pin 110.

Figure 2:
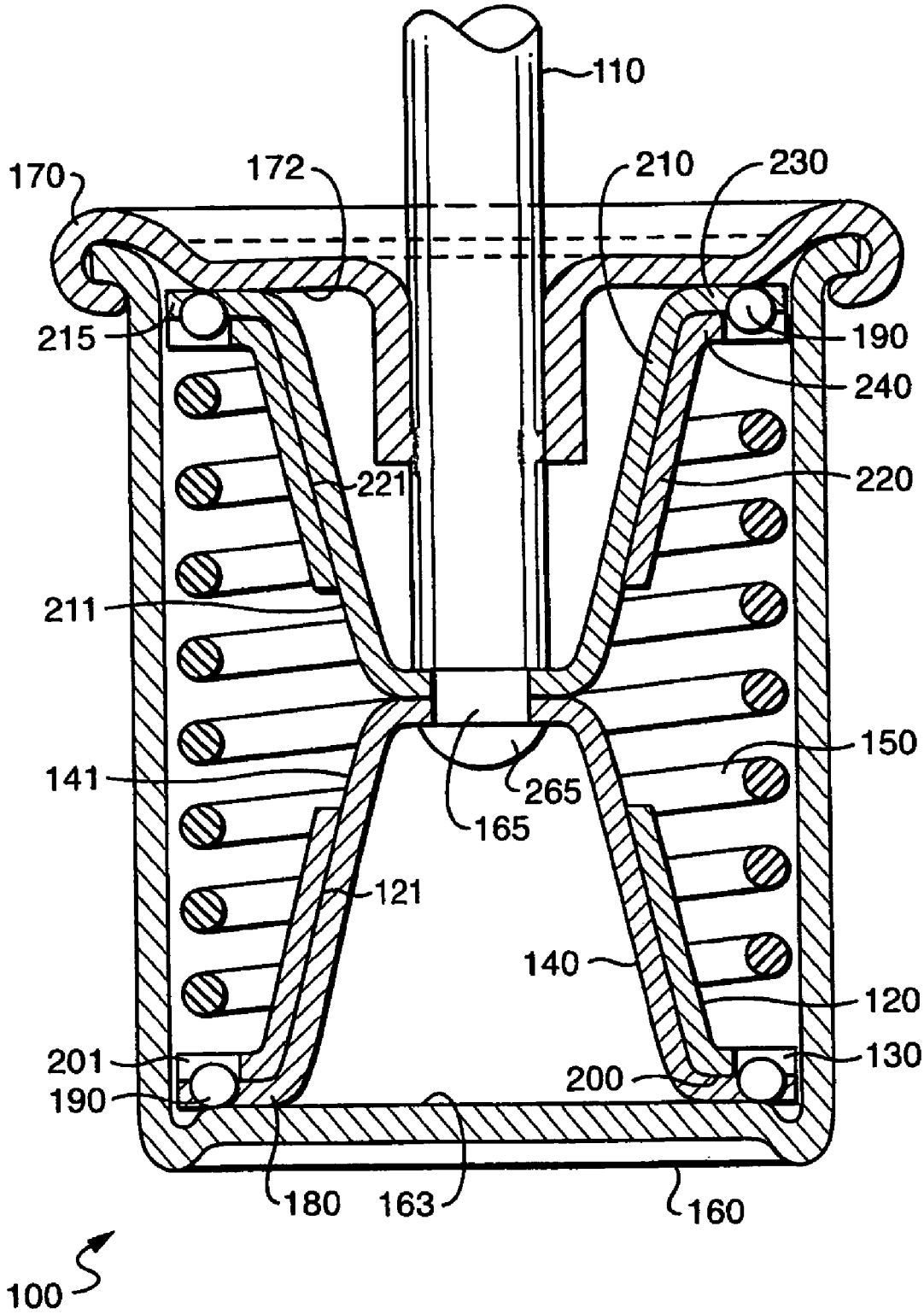
FIG. 2 is a cross section view of an assembled friction door check device in a locked position.

FIG. 2 provides a cross section profile image of an assembled friction door check device 100 in a locked position. As shown, the first and second inner cones 140 and 210 are engaged with the first and second outer cones 120 and 220, respectively, via the first and second inner cone engagement surfaces 141 and 211 and first and second outer cone engagement surfaces 121 and 221. In preferred embodiments, the spring 150 contacts the first and second outer cone flanges 130 and 240 to bias the first and second outer cone flanges 130 and 240 against the first and second inner cone flanges 180 and 230. Thus, the first inner cone flange 180 engages the housing cover inner surface 172 and the second inner cone flange 230 engages the housing lower surface 163.

Still referring to FIG. 2, the hinge pin 110 is inserted through the housing cover 170. The drive 165 of the hinge pin 110 and the rivet 265 secure the first and second inner cones 140 and 210 to one another. In some embodiments, the drive of the hinge pin 110 is swaged to form a head at the interface of the first inner cone 140 and the second inner cone 210.

Still referring to FIG. 2, the outer cone flange ball bearings 190 are located in the indexed depressions 201 along the first and second inner cone flange cam surfaces 200 and 215. The positioning of the respective ball bearings in the respective cam surfaces further assists in the locking of the friction door check device 100 in a series of indexed positions.

FIGS. 3A–D provide profile views of the inner cone (applicable for both the first outer cone and the second outer cone), a ball bearing (applicable for the outer cone flange ball bearings 190) and the inner cone flange cam surface (applicable for both the first inner cone flange cam surface 200 and the second inner cone flange cam surface) in locked and released positions. For description purposes, FIG. 3 will be described in terms of the first outer cone flange 130, first inner cone flange 180, outer cone flange ball bearing 190, indexed depressions 201 and first inner cone flange cam surface 200.

Figure 3A:
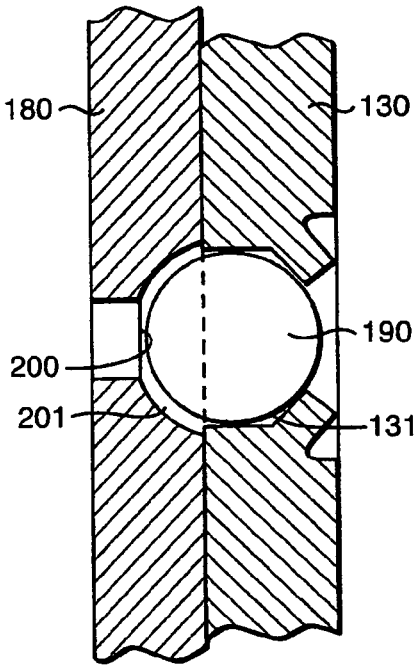
FIG. 3A–E provide profile views of a friction door check device.

FIG. 3A shows an outer cone flange ball bearing 190 in a locked position within an indexed depression 201 in the first inner cone flange cam surface 200. The outer cone flange ball bearing 190 is also secured within the outer cone flange 130 in a ball bearing chamber 131. A minimal amount of clearance is present between the first outer cone flange ball bearing 190 and the first inner cone flange cam surface 200. This position corresponds to position 280 (denoted by the arrow) in FIG. 3E wherein the ball bearing 190 is approximately in the center of indexed depression 201 in the cam surface 200. Still referring to FIG. 3E, the indexed depression 201 in the cam surface 200 is deepest at position 280 (the locked position) and becomes progressively shallower in the direction of position 283 (a release position). Although not clearly shown, a minimal amount of clearance preferably exists between inner cone flange 180 and outer cone flange 130.

Figure 3C:
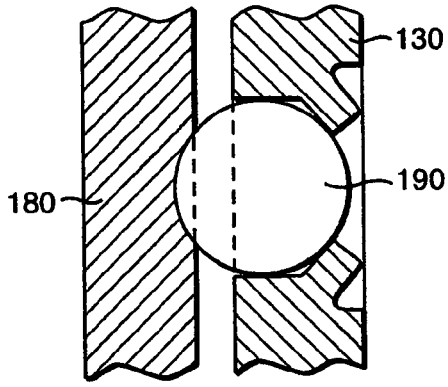
Figure 3D:
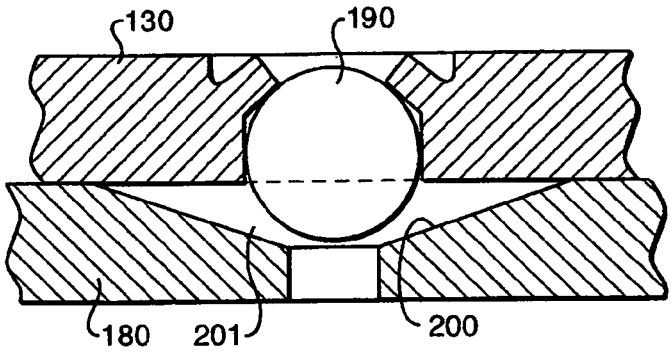
Figure 3B:
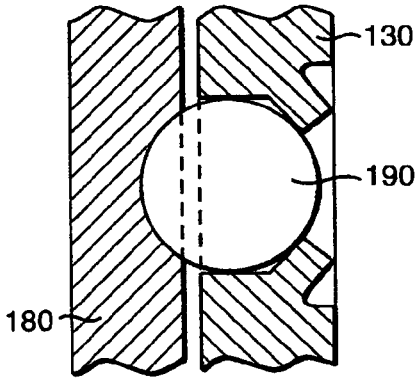
Figure 3E:
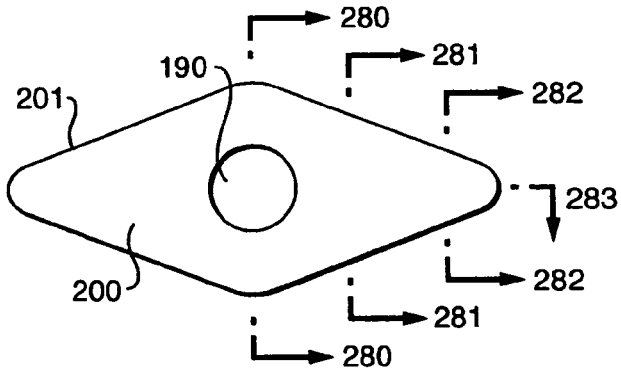

FIG. 3B shows a first outer cone flange ball bearing 190 in an initial released position as the ball bearing travels up the incline of indexed depression 201 of the first inner cone flange cam surface 200. Referring to FIG. 3E, this position corresponds to position 281 as denoted by the arrow. As shown, the first outer cone flange 130 is disengaged from first inner cone flange 180, which results in the disengagement of the first and second inner cone engagement surfaces and first and second outer cone engagement surfaces. Furthermore, the traveling of the outer cone flange ball bearing 190 up the incline of the indexed depression of the first inner cone flange cam surface 200 allows the first inner cone to rotate while the first outer cone remains in a fixed position.

FIG. 3C shows an outer cone flange ball bearing 190 in a released position at the apex (position 282 in FIG. 3E as denoted by the arrow) of the indexed depression of the first inner cone flange cam surface 200.

FIG. 3D shows a first outer cone flange ball bearing 190 in a locked position within an indexed depression 201 along the first inner cone flange cam surface 200. As in FIG. 3A, a minimal amount of clearance is present between the outer cone flange ball bearing 190 and the first inner cone flange cam surface 200. As in FIG. 3A, the first outer cone flange 130 can engage the first inner cone flange 180. However, in a preferred arrangement, although not shown, a minimal clearance is desired between flange 130 and flange 180.

Figure 4A:
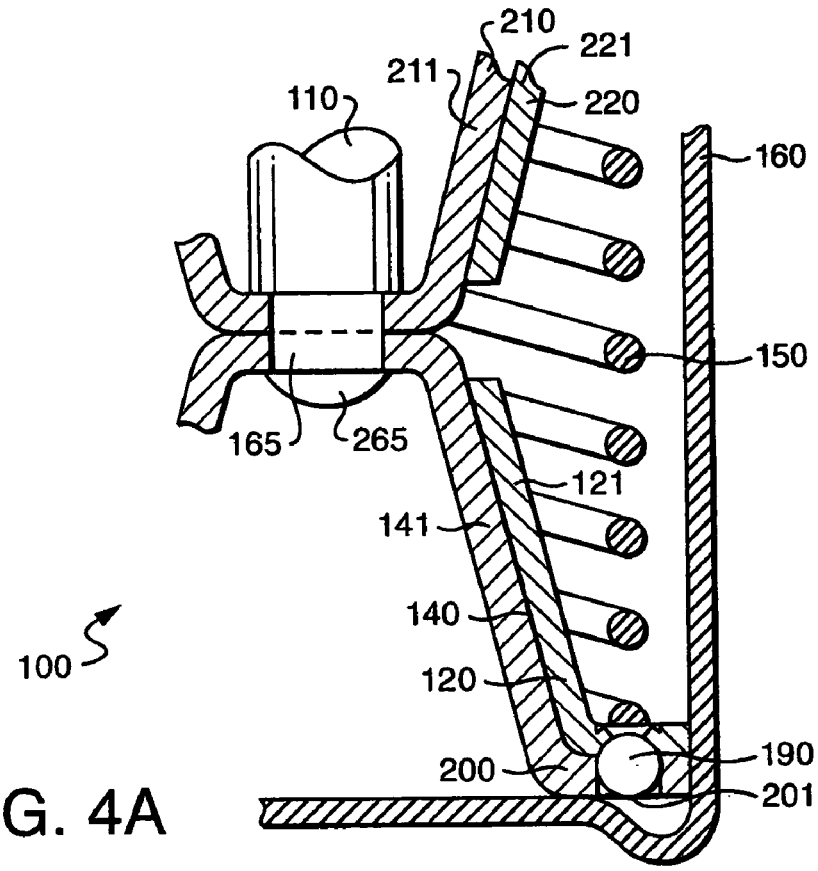
FIGS. 4A–B provide cross sections of a friction door check device in locked and released positions.

FIGS. 4A and B provide cross sections of a friction door check device 100 in locked and released positions. FIG. 4A shows the friction door check device 100 in a locked position. As shown, the first outer cone 120 is engaged with the first inner cone 140, and the second outer cone 220 is engaged with the second inner cone 210. The respective outer cones are fixed in position with respect to the housing 160. The drive 165 of the hinge pin 110 is positioned at the interface of the respective inner cones, with the rivet 265 positioned on the inside of the second inner cone 210. An outer cone flange ball bearing 190 is shown in a locked position (i.e., position 280 in FIG. 3E) within an indexed depression 201 along the first inner cone flange cam surface 200. Although not shown, a minimal clearance can exist between ball 190 and surface 200. The spring 150 encircles the outside of the respective outer cones 120 and 220. The spring 150 biases the first and second outer cones 120 and 220 against the respective first and second inner cones 140 and 210 so that the first and second inner cone engagement surfaces 141 and 211 and first and second outer cone engagement surfaces 121 and 221 contact one another. When the device is in a locked position, the friction between the engagement surfaces of the inner and outer cones limits rotation about the hinge pin 110.

Figure 4B:
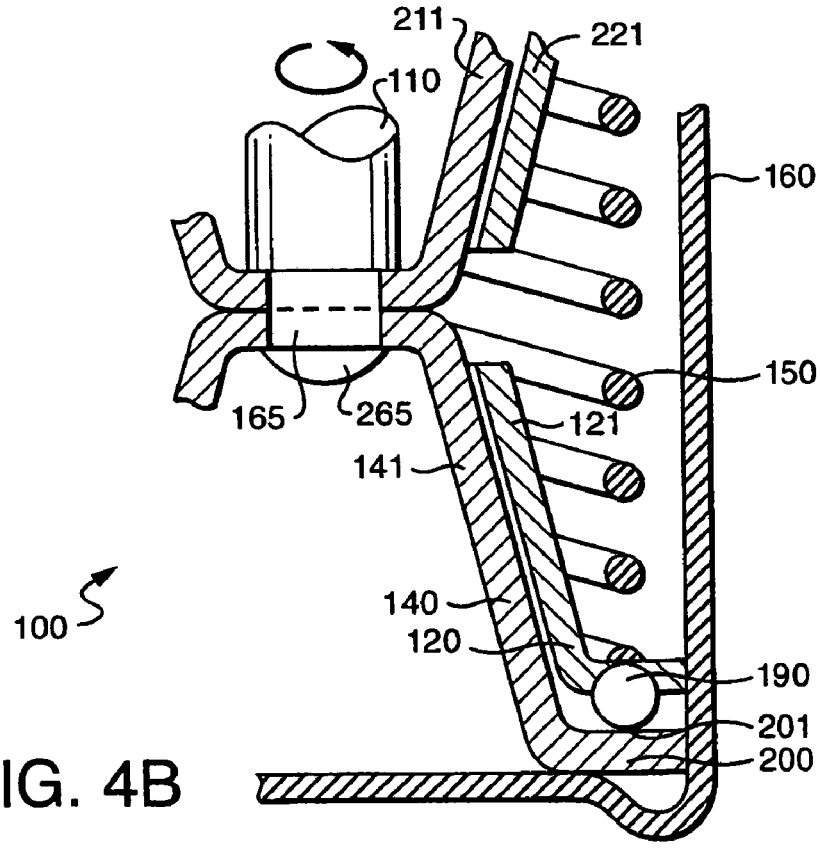

FIG. 4B shows the friction door check device 100 in a released position. Application of a force sufficient to overcome the friction force provided inner and outer cone engagement surfaces allows rotation about the hinge pin 110. Rotation of the hinge pin 110 moves the outer cone flange ball bearing 190 up the incline of the indexed depression 201 of the first inner cone flange cam surface 200. The movement of the ball bearings (e.g., the first outer cone flange ball bearing 190) out of the indexed depression 201 of the cam surface (e.g., the first inner cone flange cam surface 200) causes the respective inner cones to disengage from the respective outer cones. While the respective outer cones remain rotationally fixed within the housing 160, the outer cones are allowed to move axially. Disengagement of the respective inner cones from the respective outer cones substantially reduces the friction between the inner and outer cone engagement surfaces thereby permitting the respective inner cones to easily rotate along with the hinge pin 110.

Figure 5A:
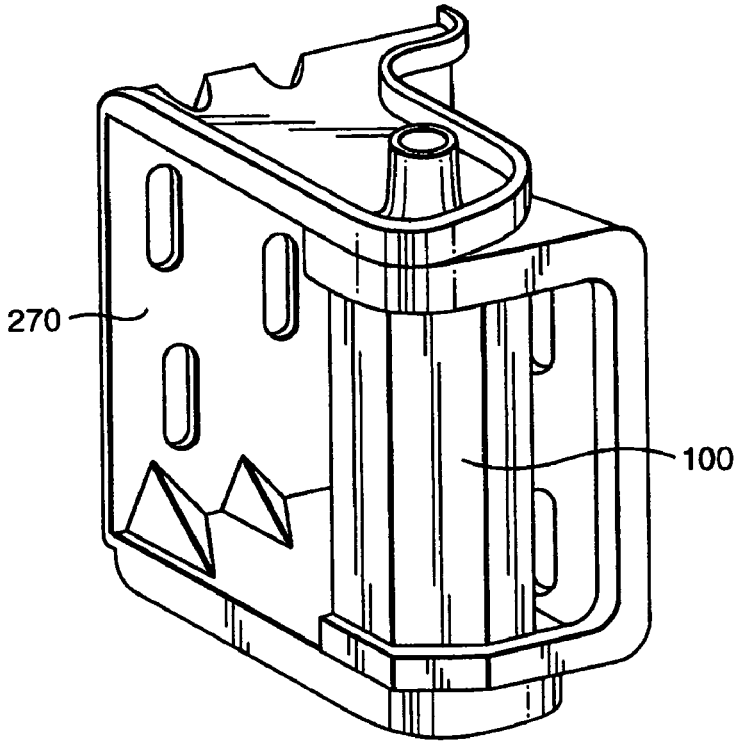
FIGS. 5A–B provide views of a friction door check device internal of a door hinge and external of a door hinge.
Figure 5B:
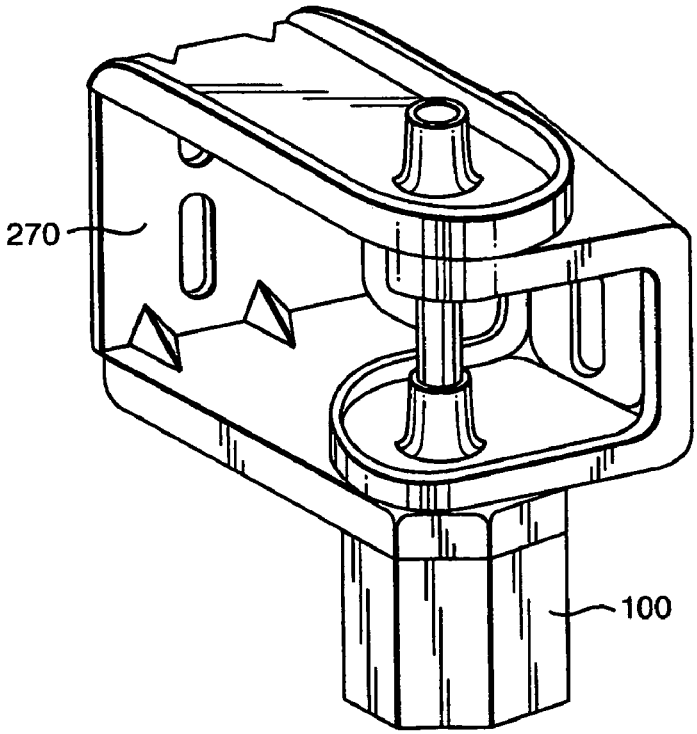

In some embodiments, as shown in FIG. 5A, the friction door check device 100 is positioned internal to the door hinge 270. In other embodiments, as shown in FIG. 5B, the friction door check device 100 is positioned external to the door hinge 270.

In preferred embodiments of the invention, upon attachment with a door or other device (e.g., an automobile door or gate) the friction door check device operates in the following manner. In a closed position (e.g., when the door is closed), the outer flange ball bearings are positioned within the indexed depressions along the inner cone flange cam surface. The outer cones engage the housing so as to fix the outer cones with respect to the housing, and prevent rotation of the outer cones. The spring biases the outer cones against the associated inner cones, thereby providing the friction required to hold the door in a predetermined position (i.e., a position determined by the indexed depressions in the cam surface). To release the door from the locked position, a force must be provided that overcomes the holding force provided by the inner cones, outer cones, and the spring. As the hinge pin is rotated, the inner cones rotate, thereby pushing the outer cone flange ball bearings out of the indexed depressions and up the incline along the inner cone flange cam surfaces, which in turn causes the outer friction cones to disengage from the inner cones. Although the outer cones do not rotate, the outer cones do move in an axial direction to allow the separation of the cones, thereby allowing the door to move with little force. As the door moves and reaches a next detent position (corresponding to the indexed depressions), the springs push the outer cones in such a manner that the outer cone flange ball bearings come to rest in the next associated indexed depression along the inner cone flange cam surface.

The friction door check device is not limited to use solely within traditional door hinges. In preferred embodiments, the friction door check device of the present invention may be used with automobile doors, automobile trunk lids, automobile hood lids, and automobile rear deck lid doors.

Infinite Position Friction Door Check Device

The infinite position friction door check device is also useful for automotive applications (e.g., automobile doors, automobile hoods, automobile trunks, etc.) as well as virtually any device that employs a hinge (e.g., gates). The infinite position friction door check device provides a number of improvements over the prior art. First, in preferred embodiments, the infinite position friction door check device of the present invention permits a door to be opened to an infinite number of positions for a person's entry or exit. Thus, the infinite position friction door check device is not dependant upon predetermined detent positions but is infinitely variable. Second, in preferred embodiments, the infinite position friction door check device of the present invention can be assembled either into a door hinge and be an integral part of the assembly, or outside of a door hinge and be an external part of the assembly. Third, in preferred embodiments, a housing totally encloses the infinite position friction door check device of the present invention thereby preventing entrance of grit or moisture into the device and disruption of function.

Figure 6:
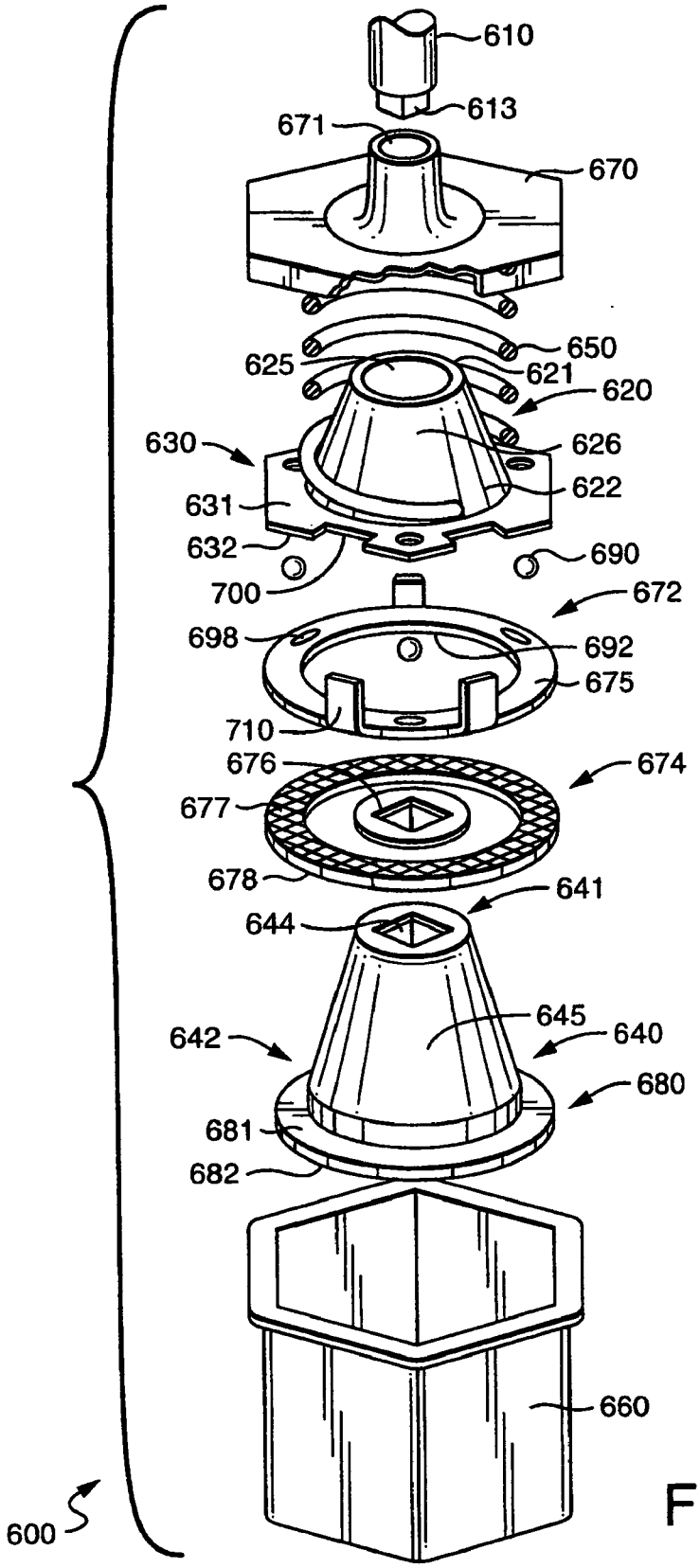
FIG. 6 is an exploded view of a infinite position friction door check device.

Referring to FIG. 6, the infinite position friction door check device 600 is preferably configured to receive and interface with a hinge pin 610. In some embodiments, the device 600 comprises an outer cone 620 having an outer cone flange 630, an inner cone 640 having an inner cone flange 680, a spring 650, a housing 660, a housing cover 670, a cam plate 672, a friction disc 674, and a friction washer 676. The components of the device 600 are not limited to a particular material composition (e.g., steel, titanium, or mixture thereof). In preferred embodiments, the material composition of the components of the device 600 is draw quality steel (e.g., SAE 1050 Draw Quality Steel) unless otherwise noted. The outer cone 620 may be heat treated to a desired hardness (e.g., RC 45–50 or RB values between 1 and 100). In preferred embodiments, the outer cone 620 is heat treated to a RC 45–50 or RB 70 hardness. In preferred embodiments, the inner cone 640 is SAE 1050 Draw Quality Steel. The inner cone 640 may be heat treated to a desired hardness (e.g., RC 45–50 or RB values between 1 and 100). In preferred embodiments, the inner cone 640 is heat treated to a RC 45–50 or RB 50 hardness.

Referring to FIG. 6, in some embodiments, the shape of the outer cone 620 is conical with a narrowed top end 621 and a wider bottom end 622. The top end 621 has an opening 625 therein shaped to receive the hinge pin 610. The outer cone 620 also has an outer cone engagement surface 626. The outer cone 620 fits onto the inner cone 640 (discussed in more detail below). In some embodiments, the shape of the inner cone 640 is conical with a narrowed top end 641 and a wider bottom end 642. The top end 641 has an opening 644 therein shaped to receive the hinge pin 610. In preferred embodiments, the opening 644 corresponds to the shape of the hinge pin drive 613. In some preferred embodiments, the opening 644 is square shaped. The inner cone 640 has an inner cone engagement surface 645. The outer cone 620 fits onto the inner cone 640 such that the inner cone inner and outer cone engagement surfaces 626 and 645 contact one another (described in more detail below). In some embodiments, as shown in FIG. 6, the inner cone 640 has an inner cone flange 680 with upper and lower surfaces 681 and 682. In preferred embodiments, the upper surface 681 of the inner cone flange 680 is engageable with the friction disc 674 (described in more detail below).

Still referring to FIG. 6, the outer cone flange 630 extends from the bottom end 622 of the outer cone 620. The outer cone flange 630 is not limited to any particular shape. Indeed, the outer cone flange can assume a variety of shapes (e.g., non-circular shaped, hexagonal shaped, oval shaped, square shaped, rectangular shaped, star shaped). In preferred embodiments, the shape of the outer cone flange 630 corresponds to the shape of the housing 660 so as prevent rotation of the outer cone 620 within the housing 660. In some preferred embodiments, the outer cone flange 630 is hexagonal in shape. In some embodiments, as shown in FIG. 6, the outer cone flange 630 has upper and lower surfaces 631 and 632. The lower surface of the outer cone flange 630 has a plurality of pockets therein that are sized to accept ball bearings 690. In some embodiments, as shown in FIG. 6, the outer cone flange 630 has at least one outer cone flange recess 700 therein. In further embodiments, the upper surface of the cam plate 672 comprises at least one cam plate upwardly extending locking member 710. In preferred embodiments, the outer cone flange recesses 700 are sized to allow movement of the cam plate upwardly extending locking member within the recesses, and thus the cam plate 672, between lock and release positions (described in more detail below).

Still referring to FIG. 6, the housing 660 is shaped to correspond to the shape of the outer cone flange 630 as described above. Accordingly, the housing 660 may assume any type of shape (e.g., non-circular shaped, hexagonal shaped, oval shaped, square shaped, rectangular shaped, star shaped). In preferred embodiments, the shape of the housing 660 is hexagonal. Still referring to FIG. 6, the spring 650 extends around the outer cone 620 thereby biasing the outer cone 620 against the inner cone 640 when the device is in a locked position.

Still referring to FIG. 6, the cam plate 672 has upper and lower surfaces 675 and 692. In preferred embodiments, the upper surface 675 of the cam plate 672 contacts the lower surface of the outer cone flange 640 (described in more detail below). In some embodiments, the cam plate 672 further comprises a plurality of depressions 698. In preferred embodiments, the depressions 698 along the cam plate 672 are spaced to correspond to the positioning of the ball bearings 690.

Still referring to FIG. 6, the friction disc 674 has upper and lower surfaces 677 and 678. Preferably, the upper and lower surfaces 677 and 678 of the friction disc 674 provide a desired coefficient of friction between the inner cone flange 680 and the cam plate 672. In preferred embodiments, the lower surface 678 of the friction disc 674 is engageable with the upper surface 681 of the inner cone flange 680. In the locked position, the outer cone flange ball bearings 690 are located in the indexed depressions of the cam plate and the outer cone 620 and inner cone 640 are engaged (described in more detail below). In the release position, upon rotation of the inner cone 640 the friction disc 674 causes the cam plate 672 to rotate so that the outer cone flange ball bearings 690 cause the outer cone 620 to disengage the inner cone 640 so that the hinge pin 610 pivots, and wherein rotation of the cam plate 672 is limited by the engagement of the cam plate upwardly extending locking members 710 with the outer cone flange 630 (described in more detail below).

Still referring to FIG. 6, the housing cover 670 has a central opening 671 therein through which the hinge pin 610 is insertable. Upon assembly of the infinite position friction door check device 600, the housing cover 670 encloses the housing 660 and serves as a guide for the insertion of the hinge pin 610.

Figure 7:
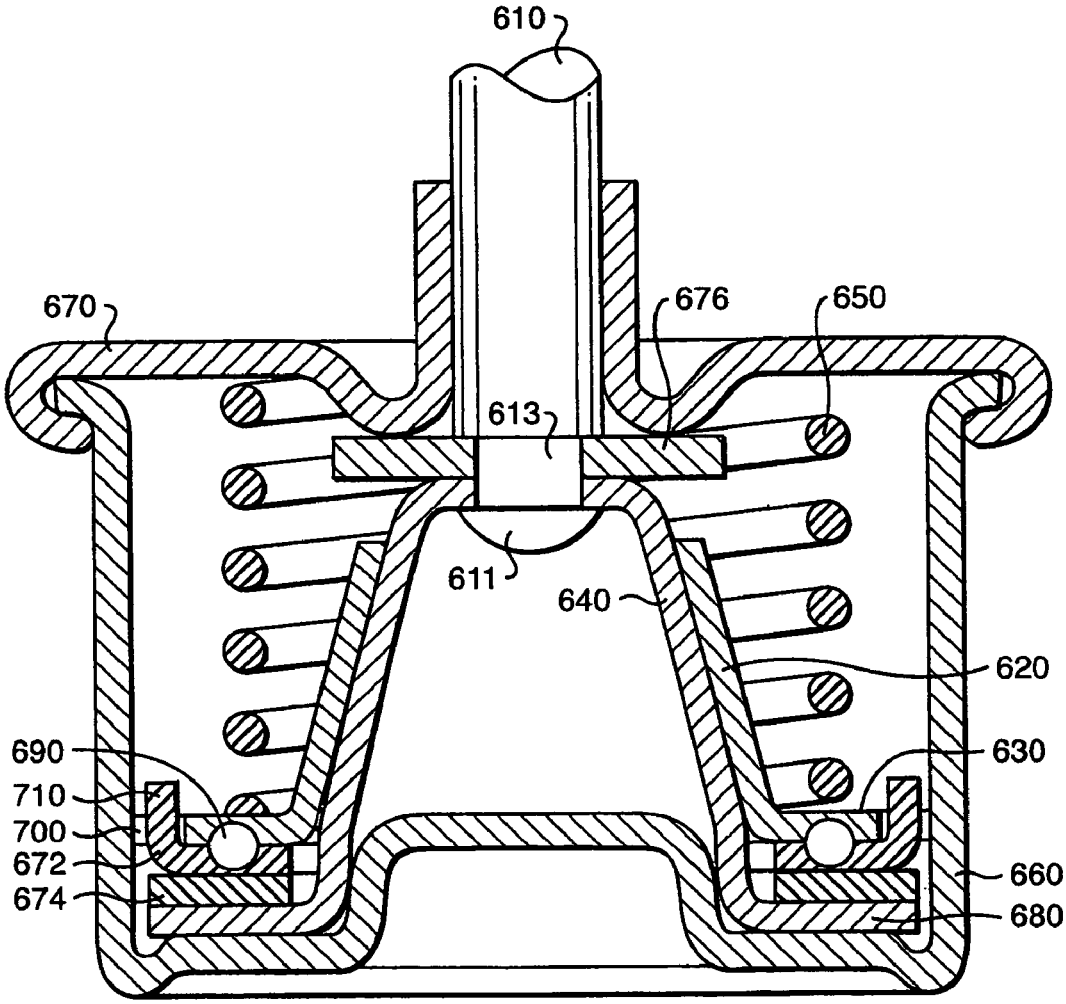
FIG. 7 is a cross section illustrating an assembled infinite position friction door check device in a locked position.

FIG. 7 provides a cross section of an assembled infinite position friction door check device 600 in a locked position. As can be seen, the hinge pin 610 comprises a shaped (e.g., non-circular shaped, hexagonal shaped, oval shaped, square shaped, rectangular shaped, star shaped) drive 613 that interfaces with the inner cone 640 (described in more detail below). In preferred embodiments, the hinge pin drive 613 is square shaped. In some embodiments, the drive 613 of the hinge pin 610 is swaged to form a head which secures the hinge pin 610 to the inner cone 640. The housing cover 670 encloses the housing 660 and serves as a guide for the insertion of the hinge pin 610. The upper surface of the washer 676 is engageable with the housing cover 670, and the lower surface of the washer 676 is engageable with the upper surface of the inner cone 640.

Still referring to FIG. 7, the inner cone 640 is engaged with the outer cone 620 so that the inner and outer cone engagement surfaces contact one another. The spring 650 engages the housing cover 670 and the outer cone flange 630 to bias the outer cone 620, cam plate 672, friction disc 674 and inner cone 640 against one another and the housing 660. In preferred embodiments, the upper surface of the cam plate 672 is biased against the lower surface of the outer cone flange 640 and the upper surface of the friction disc 674. Two outer cone flange ball bearings 690 are shown positioned in the depressions in the cam plate 672, and the upper surface of the inner cone flange 680 is biased against the lower surface of the friction disc 674. The cam plate upwardly extending locking members 710 are positioned within the outer cone flange recesses 700.

Figure 8A:
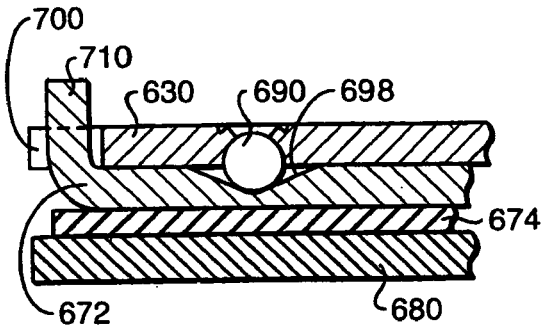
FIGS. 8A–B provide partial cross sections illustrating the infinite position friction door check device in locked and released positions.

FIGS. 8A and B provide partial cross sections of the inner cone flange 680, the friction disc 674, the cam plate 672, the outer cone flange recessions 700, the cam plate upwardly extending locking members 710, the outer cone flange ball bearing 690, and the outer cone flange 630 in locked and released positions.

FIG. 8A depicts a device in a locked position. The outer cone flange ball bearing 690 is positioned within a depression 698 along the cam plate 672. As seen in cross section, the depression 698 has a deep central portion and becomes progressively shallower in each direction. As shown, the lower surface of the outer cone 620 engages the upper surface of the cam plate 672. The cam plate upwardly extending locking member 710 is shown within the outer cone flange recess 700. The lower surface of the cam plate 672 engages the upper surface of the friction disc 674, and the lower surface of the friction disc 674 engages the upper surface of the inner cone flange 680.

Figure 8B:
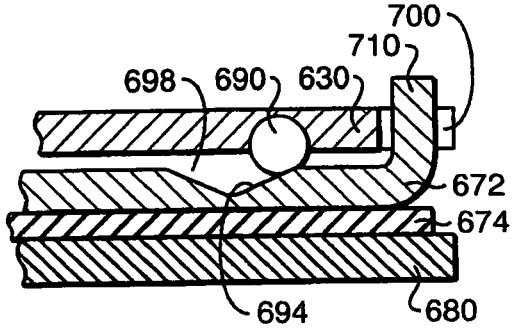

FIG. 8B depicts a device 600 in a released position. The outer cone flange ball bearing 690 is shown traveling up the incline surface 694 of the depression 698 along the cam plate 672. The movement of the ball bearing 690 causes the disengagement of the outer cone flange 630 from the cam plate 672.

Figure 9A:
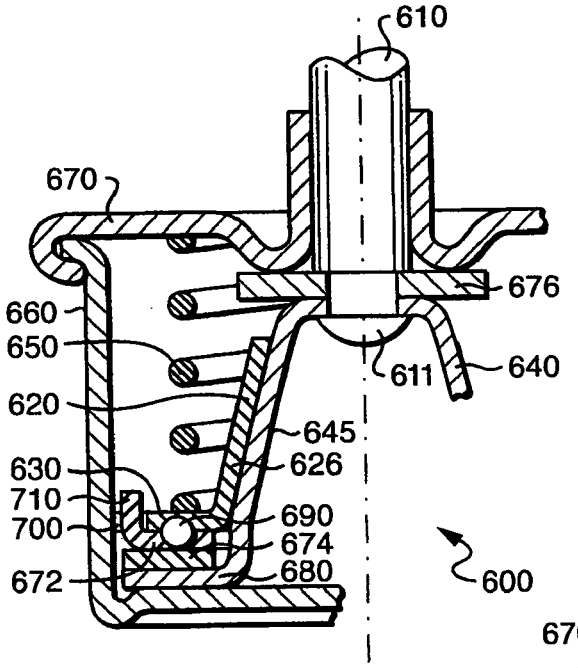
FIGS. 9A–B provide cross sections of an infinite position friction door check device in locked and released positions.

FIGS. 9A and B show cross sections of an infinite position friction door check device 600 in locked and released positions. FIG. 9A shows the device 600 in a locked position. As shown, the inner cone 640 is engaged within the outer cone 620 with inner and outer cone engagement surfaces 645 and 626 in contact with another. The inner cone flange 680 is in contact with the housing 660. The upper surface of the cam plate 672 engages the lower surface of the outer cone flange 640 and the upper surface of the friction disc 674. The outer cone flange ball bearing 690 is positioned in a depression in the cam plate 672. The upper surface of the inner cone flange 680 engages the lower surface of the friction disc 674. The lower surface of the friction disc 674 engages the upper surface of the inner cone flange 680. The cam plate upwardly extending locking member 710 extends through the outer cone flange recession 700.

Figure 9B:
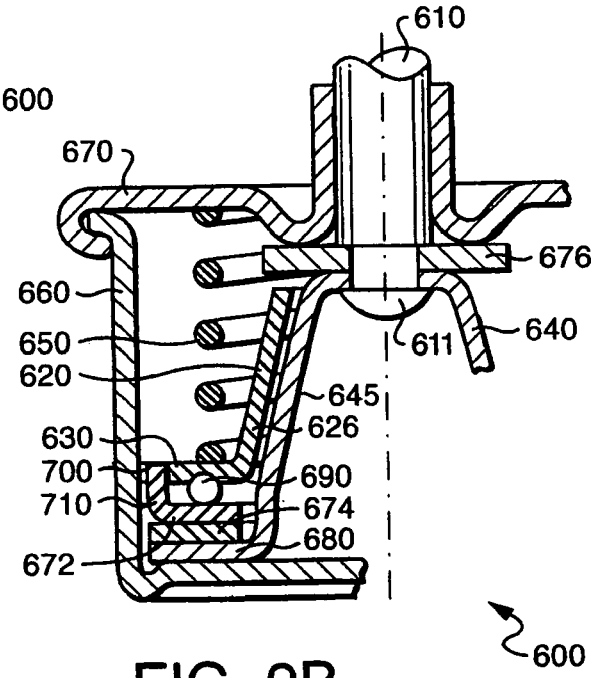

FIG. 9B depicts the device 600 in a released position. Rotation of the hinge pin 610 moves the outer cone flange ball bearing 650 up the incline of the depression in the cam plate 672. The movement of the outer cone flange ball bearing 650 out of the depression in the cam surface 672 causes the inner cone 640 to disengage from the outer cone 620. The outer cone 620 remains rotationally fixed against the housing 660 while being free to move axially.

Figure 10C:
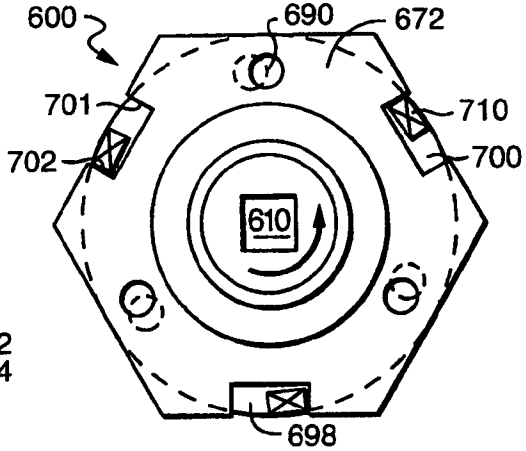
FIGS. 10A–F provide various views illustrating an infinite position door check device in stationary (10A and B), counterclockwise rotation (10C and D) and clockwise rotation (10E and F).
Figure 10B:
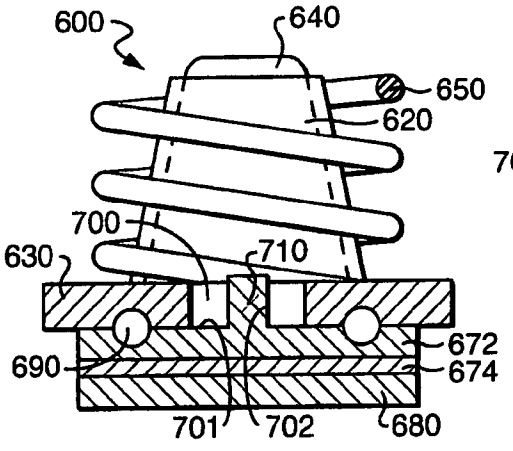
Figure 10A:
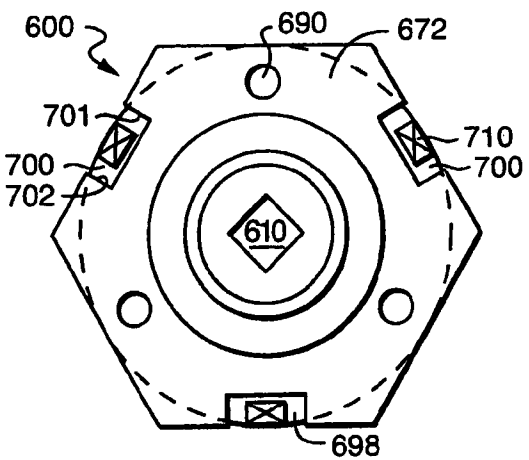

FIGS. 10A–F provide schematic and partial cross-section views that demonstrate the interaction of the cam plate upwardly extending members with the outer cone recesses. FIGS. 10A and 10B show the device 600 in a locked position. Referring to FIG. 10B, the ball bearings 690 are positioned in the cam plate depressions 698 so that the upper cone flange 630 is engaged with the cam plate 672. Referring to both FIGS. 10A and 10B, each outer cone flange recess 700 has first and second interior surfaces 701 and 702. In a locked position, the cam plate upwardly extending member 710 is positioned between first and second interior recess surfaces 701 and 702. As can be seen, the upwardly extending member 710 is sized to provide clearance between the first and second interior recess surfaces 701 and 702. This clearance permits limited rotation of the cam plate.

Figure 10F:
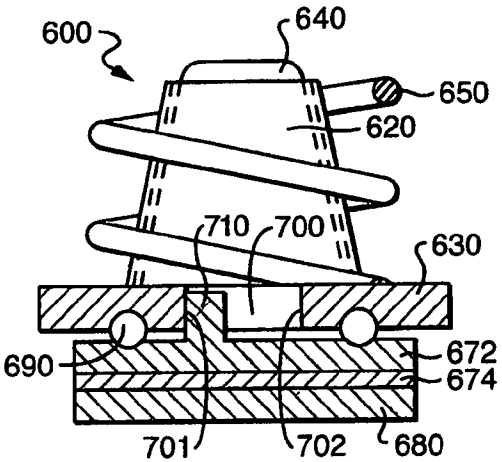
Figure 10E:
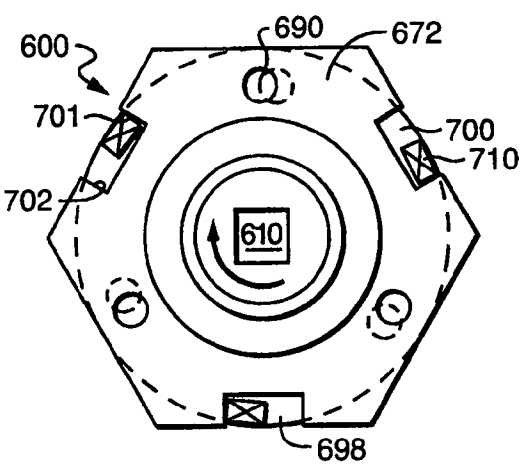
Figure 10D:
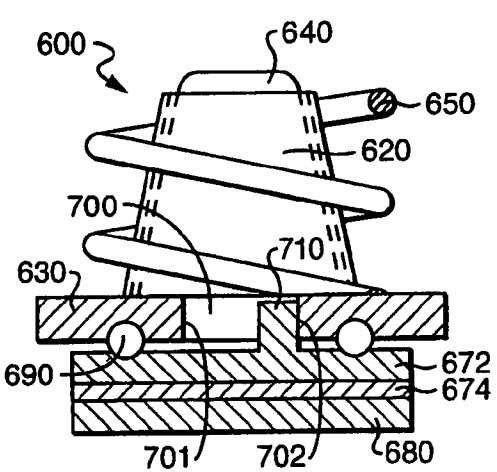

FIGS. 10C and 10D show the device in a release position after counterclockwise movement about the hinge pin 610. Referring to FIG. 10D, the ball bearings 690 have exited the depressions in the cam plate 672 causing the lower surface of the outer cone flange to disengage from the upper surface of the cam plate 672. The cam plate upwardly extending member is free to move between the first and second interior surfaces 701 and 702 so that the cam plate 672 has a limited degree of rotational freedom. In the case of counter-clockwise rotation, the rotation of the cam plate 672 is checked by engagement of the cam plate upwardly extending member 710 with the second interior recess surface 702 of the outer cone flange recess 700.

FIGS. 10E and 10F show the device in a release position after clockwise movement about the hinge pin 610. Referring to FIG. 10E, the ball bearings 690 have exited the depressions in the cam plate 672 causing the lower surface of the outer cone flange to disengage from the upper surface of the cam plate 672. In the case of clockwise rotation, the rotation of the cam plate 672 is checked by engagement of the cam plate upwardly extending member 710 with the first interior recess surface 701 of the outer cone flange recess 700.

Figure 11A:
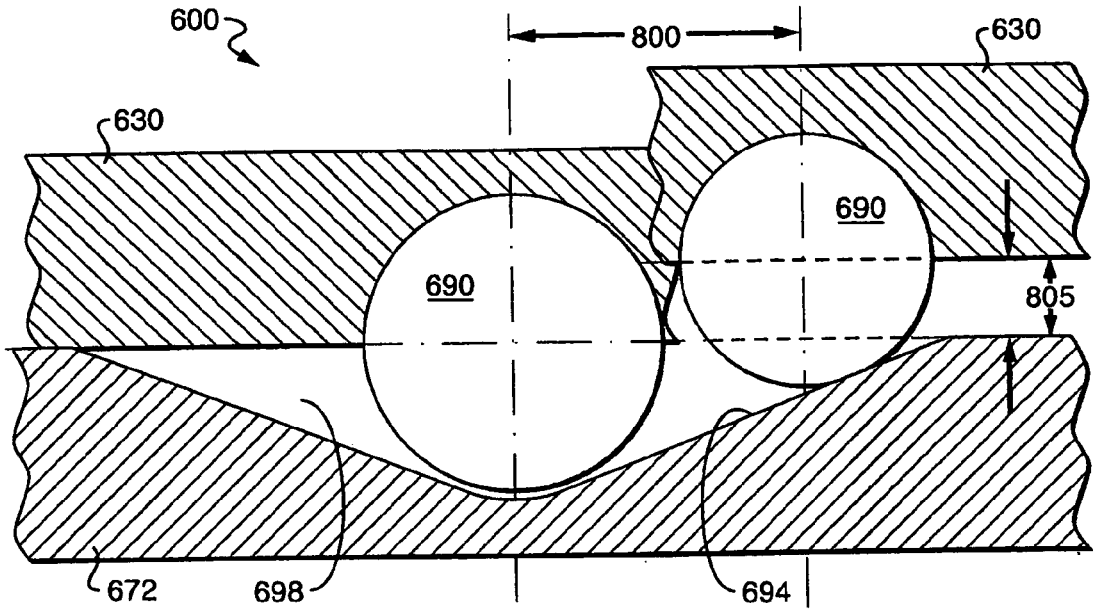
FIGS. 11A–C provide various views of the relationship of the outer cone flange ball bearing with the cam plate.
Figure 11B:
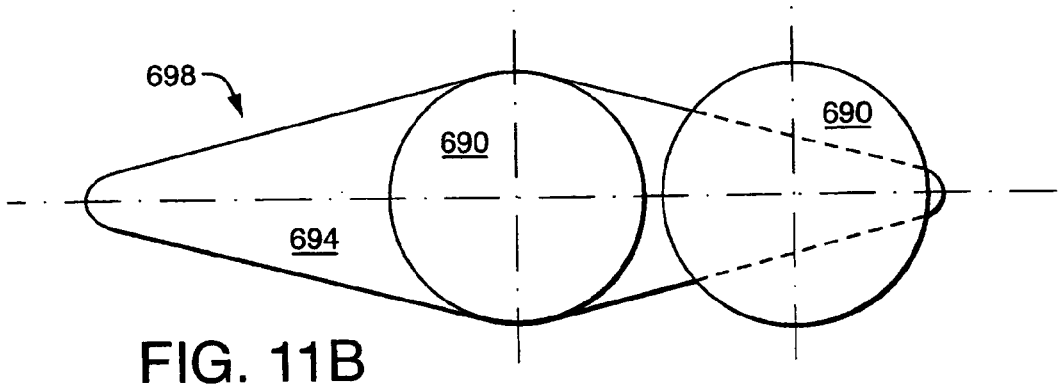
Figure 11C:
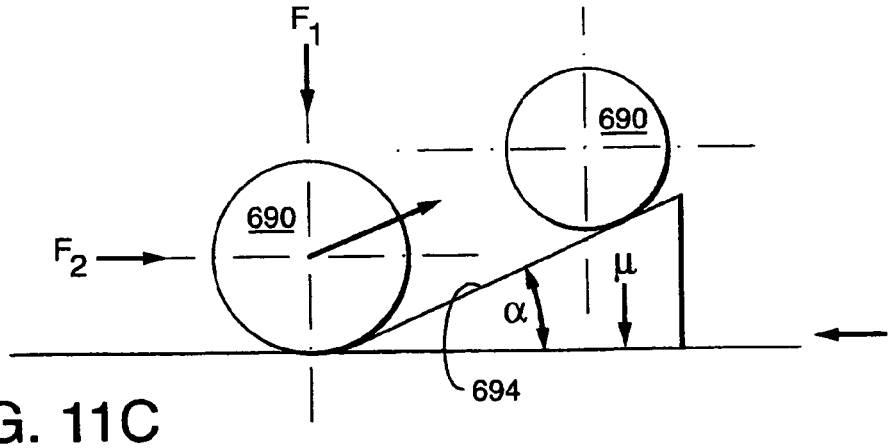

FIGS. 11A–C provide various views of the relationship between the outer cone flange ball bearing 690 and a depression 698 along the cam plate 672. FIG. 11A provides a cross sectional profile of the cam arrangement of the device 600 in locked and release positions. In the locked position, the ball bearing 690 is located in the deepest portion of the depression 698 and the outer cone flange 630 and cam plate 672 are engaged. In the release position, the ball bearing 690 has moved up the incline 694 causing the outer cone flange 630 and cam plate 672 to disengage. The maximum travel of the ball bearing 690 is indicated by arrow 800 and the maximum lift due to travel of the ball bearing 690 is indicated by arrow 805.

FIG. 11B provides a schematic overview of the cam arrangement of the device 600, and in particular, of the interaction of the ball bearing 690 with a depression 698 in the cam plate 672. As can be seen, the ball bearing 690 travels up an incline between a locked position in the center of the depression 698 and a release position at the narrow, shallow end of the depression 698.

FIG. 11C provides a diagram of the forces involved in the operation of the cam arrangement. $F_1$ is the force of the spring, $F_2$ is the force to move the ball bearing up incline $\alpha$, and $\mu$ is the coefficient of friction required to counteract $F_1$ and $F_2$.

Generally, when the device is in a locked position, the inner cone and outer cone are fully engaged within the housing and provide a maximum friction against movement, the outer cone flange ball bearings are positioned within the depressions in the cam plate, the friction disc is engaged with the inner cone flange and the cam plate, the cam plate upwardly extending locking members are centered in the outer cone flange recesses, and the spring provides a constant pressure on the friction disc and inner and outer cones. As the hinge pin begins to rotate, the cam plate rotates so that the outer cone flange ball bearings travel up the incline of the depressions in the cam plate thereby causing disengagement of the outer cone from the inner cone and releasing the friction between the cones. The rotation of the cam plate is limited by engagement of the cam plate upwardly extending locking members with the outer cone flange recess interior surfaces. While the rotation of the cam plate is thereby checked, the inner cone is free to continue to rotate. Subsequent rotation of the inner cone requires a sufficient force to overcome the friction between the inner cone flange, friction disc, and cam plate, which causes the door to feel stiff or tight. When the inner cone stops rotating, the outer cone flange ball bearings roll back to the deepest point of the indexed depression along the cam plate thereby lowering the outer cone back onto the inner cone which in turn locks the inner and outer cones.

All publications and patents mentioned in the above specification are herein incorporated by reference. Although the invention has been described in connection with specific preferred embodiments, it should be understood that the invention as claimed should not be unduly limited to such specific embodiments. Indeed, various modifications of the described modes for carrying out the invention that are obvious to those skilled in the relevant fields are intended to be within the scope of the following claims.

We claim:

1. A device for checking rotation of a hinge pin, comprising:

an outer cone comprising a flange containing at least three ball bearings and at least one cam plate upwardly extending locking member opening;

an inner cone having at opening therein for receiving a hinge pin such that when said hinge pin is rotated, said inner cone rotates within said outer cone;

a cam plate positioned between said inner and outer cones, said cam plate comprising depressions corresponding to the positions of said ball bearings and at least one upwardly extending locking member positioned within said at least one opening in said outer cone flange, said opening sized to allow movement of said upwardly extending locking member between lock and release positions wherein the rotation of said cam plate is limited by the engagement of said upwardly extending locking member with said outer cone flange; and a friction disc between said cam plate and an inner cone flange upper surface, wherein said inner cone is movable between a locked position wherein said ball bearings are located in said depressions and said outer and inner cones are engaged and a release position wherein upon rotation of said inner cone said friction disc causes said cam plate to rotate so that the interaction of said ball bearings with said cam plate causes said outer cone to disengage said inner cone.

2. A device for checking rotation of a hinge pin comprising, a first outer cone having a first outer cone flange;

a first inner cone positioned within said first outer cone and biased against said outer cone so said first inner and outer cones engage one another, said first inner cone having an opening therein for receiving a hinge pin so that when said hinge pin is rotated, said first inner cone rotates within said first outer cone; and a housing, such that said first outer cone is positioned within said housing in such a manner that said first outer cone flange engages said housing to substantially prevail rotation of said first outer cone within said housing.

3. The device of claim 2, wherein said housing and said first outer cone flange are hexagonal in shape.

4. The device of claim 2, wherein said hinge pin is attached to a door.

5. The device of claim 2, wherein said device is interior to a hinge.

6. The device of claim 2, wherein said device is exterior to a hinge.

7. The device of claim 2, wherein said first outer cone flange has upper and lower surface, said first outer cone flange upper surface having therein at lest three ball bearings, and wherein said first inner cone comprises a flange having upper and lower surfaces, said first inner cone lower surface comprising a cam surface engageable with said ball bearings.

8. The device of claim 7, wherein said cam surface has a series depressions therein so that said inner cone is moveable between a locked position wherein said ball bearings are located in said depressions and said first inner and outer cones are engaged and a release position wherein said ball bearings exit said depressions and cause said first upper and lower cones to disengage thereby allowing ease of movement about said hinge pin.

9. The device of claim 2, further comprising a spring, said spring positioned in said housing to bias said inner cone against said outer cone.

10. The device of claim 9, further comprising a second inner cone having an opening therein for receiving said hinge pin and comprising a flange having an upper surface and a lower surface, said device further comprising a second outer cone comprising a flange that engages said housing, said first and second inner cones opposed to one another so that said spring engages said first inner cone and second inner cone flanges.

11. The device of claim 10, wherein said second outer cone flange has upper and lower surfaces, said second outer cone flange lower surface having therein at least three ball bearings, and wherein said second inner cone flange upper surface comprises a cam surface engageable with said ball bearings.

12. The device of claim 11, wherein said cam surface comprises a series of indexed depressions therein so that said second inner cone is moveable between a locked position wherein said ball bearings are located in said depressions and said second inner and outer cones are engaged and a release position wherein upon rotation said ball bearings exit said depressions causing said second upper and lower cones to disengage thereby allowing ease of movement about said hinge pin.

13. The device of claim 10, wherein said device further comprises a housing cover having a hinge pin opening therein, said cover positioned on said housing so that said first inner cone is biased against said housing cover.

14. The device of claim 9, wherein said first outer cone flange comprises upper and lower surfaces, said first outer cone flange lower surface having at least three ball bearing therein, said device further comprising a cam plate comprising a cam surface opposed to said first outer cone flange lower surface, said cam surface having therein a series of depressions corresponding to the positions of said at least three ball bearings.

15. The device of claim 14, wherein said first inner cone comprises a flange having a upper surface and wherein said cam plate comprises at lest one upwardly extending locking member and said first outer cone flange has at least one opening therein for receiving said upwardly extending locking number, said opening sized to allow movement of said at least one upwardly extending locking member within said opening between lock and release positions wherein rotation of said cam plate is limited by the engagement of said upwardly extending locking number with said first outer cone flange, said device further comprising a friction disc between said cam plate and said first inner cone flange upper surface, wherein said first inner cone is movable between a locked position wherein said ball bearings are located in said depressions and said first outer and inner cones are engaged and a release position wherein upon rotation of said inner cone said friction disc causes said cam plate to rotate so that the interaction of said ball bearings with said cam plate causes said first outer cone to disengage said first inner cone.

16. The device of claim 15, further comprising a cover fixed to said housing, said cover having therein an opening for receiving said hinge and comprising a cover interior surface, wherein said spring is biased against said cover interior surface and said outer cone flange.

17. The device of claim 16, further comprising a washer between said cover interior surface and said inner cone.

18. A device for checking rotation of a hinge pin, comprising:

a first outer cone having a flange comprising at least three ball bearings;

a first inner cone having a cam surface comprising indexed depressions;

said first inner cone having an opening therein for receiving a hinge pin so that when said hinge pin is rotated, said first inner cone rotates within said first outer cone; said cam surface engaging said ball bearings such that in a locked position said ball bearings are located within said indexed depressions and said inner and outer cones are engaged, and in a release position said ball bearings exit said indexed depressions to cause said inner and outer cones to disengage thereby allowing ease of movement about said hinge pin.

* * * * *